US006896536B1

(12) United States Patent
Nguyen et al.

(10) Patent No.: US 6,896,536 B1
(45) Date of Patent: May 24, 2005

(54) ELECTRONIC CONNECTOR UTILIZING EDGE BOARD TERMINAL SYSTEMS

(75) Inventors: Truong Nguyen, Canton, MI (US); David Kwang, Southfield, MI (US); Chris Shelly, Hummelstown, PA (US); James L. Jones, III, Canton, MI (US); Arkady Zerebilov, Lancaster, PA (US); Jeffrey Ward, Canton, MI (US)

(73) Assignee: Yazaki North America, Canton, MI (US)

( * ) Notice: Subject to any disclaimer, the term of this patent is extended or adjusted under 35 U.S.C. 154(b) by 0 days.

(21) Appl. No.: 10/624,073

(22) Filed: Jul. 21, 2003

(51) Int. Cl.[7] ..... H01R 13/62; H01R 13/627

(52) U.S. Cl. ..... 439/299; 439/325; 439/353

(58) Field of Search ..... 439/299, 296, 439/325, 344, 345, 353

(56) References Cited

U.S. PATENT DOCUMENTS 4,319,799 A * 3/1982 Pearce, Jr. ..... 439/689
4,514,030 A 4/1985 Triner et al.
4,721,482 A 1/1988 Fukuda et al.
4,726,775 A * 2/1988 Owen ..... 439/49
5,035,648 A 7/1991 Kuiper-Moore
5,292,262 A 3/1994 Endo et al.
5,498,177 A 3/1996 Tsuji
5,655,928 A 8/1997 Akeda
5,668,698 A 9/1997 Jozwiak et al.

* cited by examiner

*Primary Examiner*—Chandrika Prasad
(74) *Attorney, Agent, or Firm*—Young & Basile, P.C.

(57) ABSTRACT

A smart connector for automotive accessories comprising injection molded plastic first and second components, the first component being adapted to receive a printed circuit board with edge contacts therein. Multiple position assurance features are provided so that the PCB can only be fully inserted in the proper orientation and can only be latched in place if fully inserted. Spring terminals are crimped to the wires leading to and from the connector assembly and contactingly engage the edge contacts on the surfaces of the PCB adjacent the leading and trailing edges thereof. The first and second connector components are releasably latched together by means of an exterior detent and spring arm combination.

8 Claims, 5 Drawing Sheets

50
40
42
10
22
39
36
16
16
14
16
54
12
46
30
52

ELECTRONIC CONNECTOR UTILIZING EDGE BOARD TERMINAL SYSTEMS

FIELD OF THE INVENTION

This invention relates to releasably mating electrical connectors for establishing a circuit between a power and/or command signal source and a utilization device and more specifically to a connector assembly comprising releasably matable members adapted to incorporate a printed circuit board having edge connectors therewithin so as to provide intelligence in the circuit.

BACKGROUND OF THE INVENTION

It is becoming more common to use microprocessors, microcontrollers and the like in the electrical circuits found in automobiles to provide sophisticated control functions. One way to achieve this objective is disclosed in the co-pending application for U.S. patent Ser. No. 10/055,563 for "Scalable, Modular Architecture For Automotive Power Distribution And Body Control Functions," filed Jan. 23, 2002, and assigned to Yazaki North America, Inc. Another way is to use a so-called "smart connector"; i.e., a connector which incorporates a chip to provide intelligence in the connector itself. This approach has involved the use of lead frames which are complex and costly.

SUMMARY OF THE INVENTION

The present invention provides an electrical connector having releasably matable first and second connector components designed to incorporate therein a printed circuit board (PCB) having flush edge connectors and being capable of carrying intelligent components such as microprocessors, microcontrollers and the like. The connector assembly of the present invention provides structure to ensure that the PCB is properly oriented and fully inserted into the connector bodies. The assembly is particularly useful in automotive circuits, such as those found between a power source and, for example, a remote controlled mirror mounted on the automotive body. The invention, as will be apparent to those skilled in the art, is useful in applications other than the control of automotive utilization devices.

In general, the preferred embodiment of the invention comprises complementally releasably matable first and second connector bodies made of an injection molded plastic such as polyethylene. Each of the matable connectors is hollow and has laterally opposite guide channels to receive the opposite side edges of a small circuit board. Each of the connector bodies is molded to define a plurality of axially oriented and parallel channels receiving spring type electrical terminals which can be crimped onto the stripped ends of wires. The spring portion of the terminals is designed and oriented to engage flush edge contacts on a PCB mounted within the hollow interior volume defined by the connector bodies. Position assurance features are provided to ensure that the PCB is both properly oriented and fully inserted into the first connector body interior.

In the preferred form, the connector assembly is provided with latch means having first and second complementally interengaging portions on the exterior surfaces of the first and second connector components, respectively, to releasably latch the bodies together when telescopically engaged. In addition, the assembly comprises a first security feature which is applied to the first connector body after assembly to ensure that the PCB remains in the fully inserted position and does not move back toward the direction in which removal normally occurs. An additional security feature is preferably provided to work in combination with a PCB edge detent structure to lock the PCB in place.

Other applications of the present invention will become apparent to those skilled in the art when the following description of the best mode contemplated for practicing the invention is read in conjunction with the accompanying drawings.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
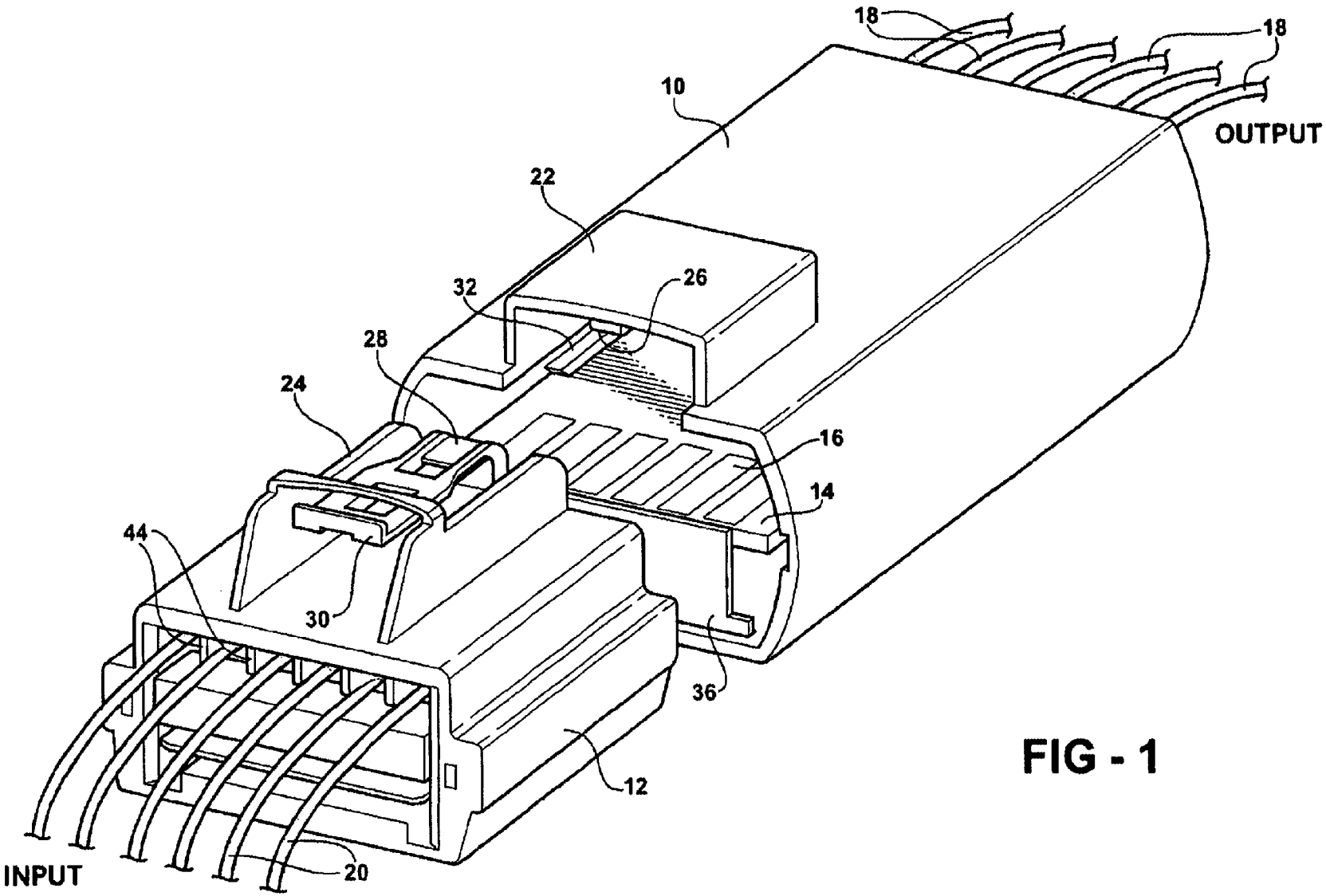
FIG. 1 is a perspective view of a connector device embodying the invention.

Referring now to the drawing, the connector assembly of the present invention is shown to comprise a molded plastic first connector 10, a molded plastic second connector 12 which slides into and latches to the first connector 10 and a printed circuit board 14 (PCB) having flush edge contacts 16 deposited or otherwise formed at the longitudinally opposite edges thereof to provide electrical circuits to intelligent components mounted on the PCB 14; examples include microprocessors, microcontrollers and components which are auxiliary thereto. Wires 20 bring power and ground and control or command signals into the second connector 12 and, through terminals to be described, to the PCB components as well. Wires 18 connect the power and ground and output control or command signals to a utilization device such as a remote control automotive mirror.

A latch feature 22 is integrally molded to the top surface of the first connector 10 and a complemental latch structure 24 is provided on the top surface of the second connector 12. Although the latches 22 and 24 may be of any number of different configurations, the present illustration provides an easily manipulated spring latch which permits the connectors 10 and 12 to be securely joined yet permits simple and easy release to separate the connectors 10 and 12 when desired. The latch feature 22 comprises a detent feature 26 integrally molded on the inside surface thereof and the complemental latch structure 24 comprises a spring arm 30 having a cam surface 28 which guides the detent 26 into a hole or aperture in the spring arm and holds it in place when the connectors 10 and 12 are coupled. A supplemental lock piece 27 shown in FIG. 2 may be inserted into the latches 22, 24 to prevent operation thereof. Acting as a connector position assurance device, the lock piece 27 detects incompletely mated connectors. If the supplemental lock piece 27 is not in place, pushing the spring arm 30 downwardly permits the connectors 10 and 12 to be taken apart.

Figure 4:
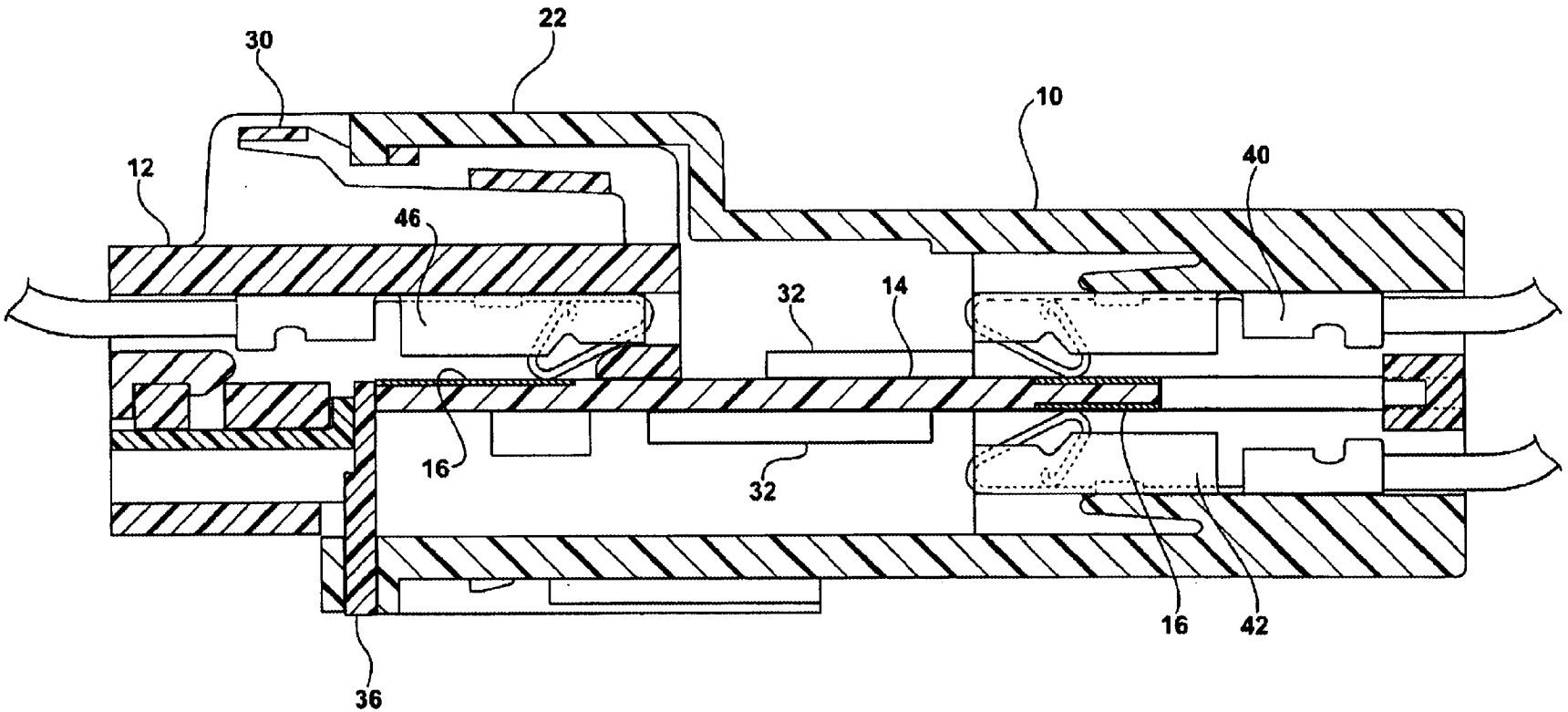
FIG. 4 is a sectional view of the device in the assembled state.
Figure 6:
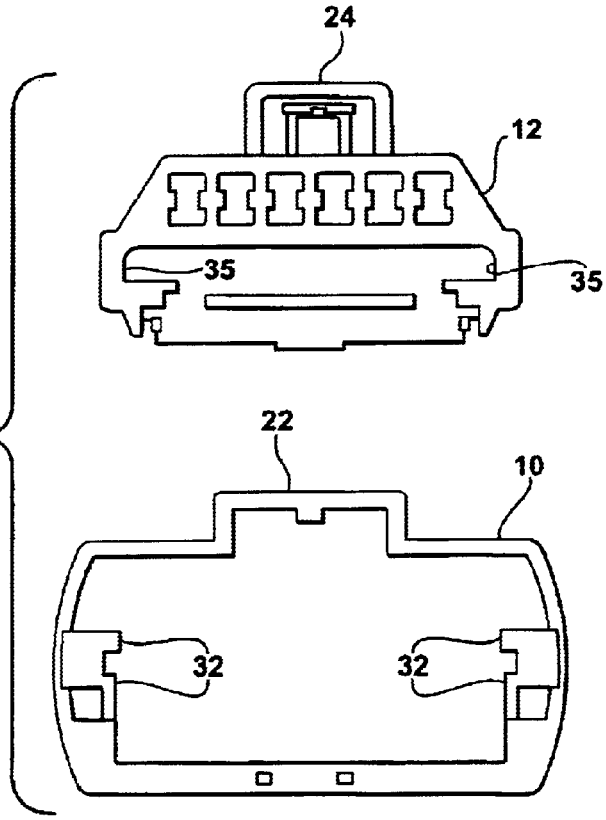
FIG. 6 is a view of the complemental open ends of the connector bodies with some interior features removed for simplicity.

As best shown in FIGS. 1 and 6, the first connector 10 is preferably injection molded of a suitable plastic such as polyethylene into a doubly truncated cylindrical shape and is provided with longitudinally extending guide ribs 32 on laterally opposite interior surfaces to provide channels which receive and guide the PCB 14 into the interior volume of the first connector 10. The length of the connector 10 along its axis of symmetry is only slightly greater than that of the PCB 14 as shown in FIG. 4. As shown in FIG. 6, the second connector 12 has guide channels 35 formed therein to receive the PCB 14 when the second connector 12 is inserted into the connector 10.

Figure 2:
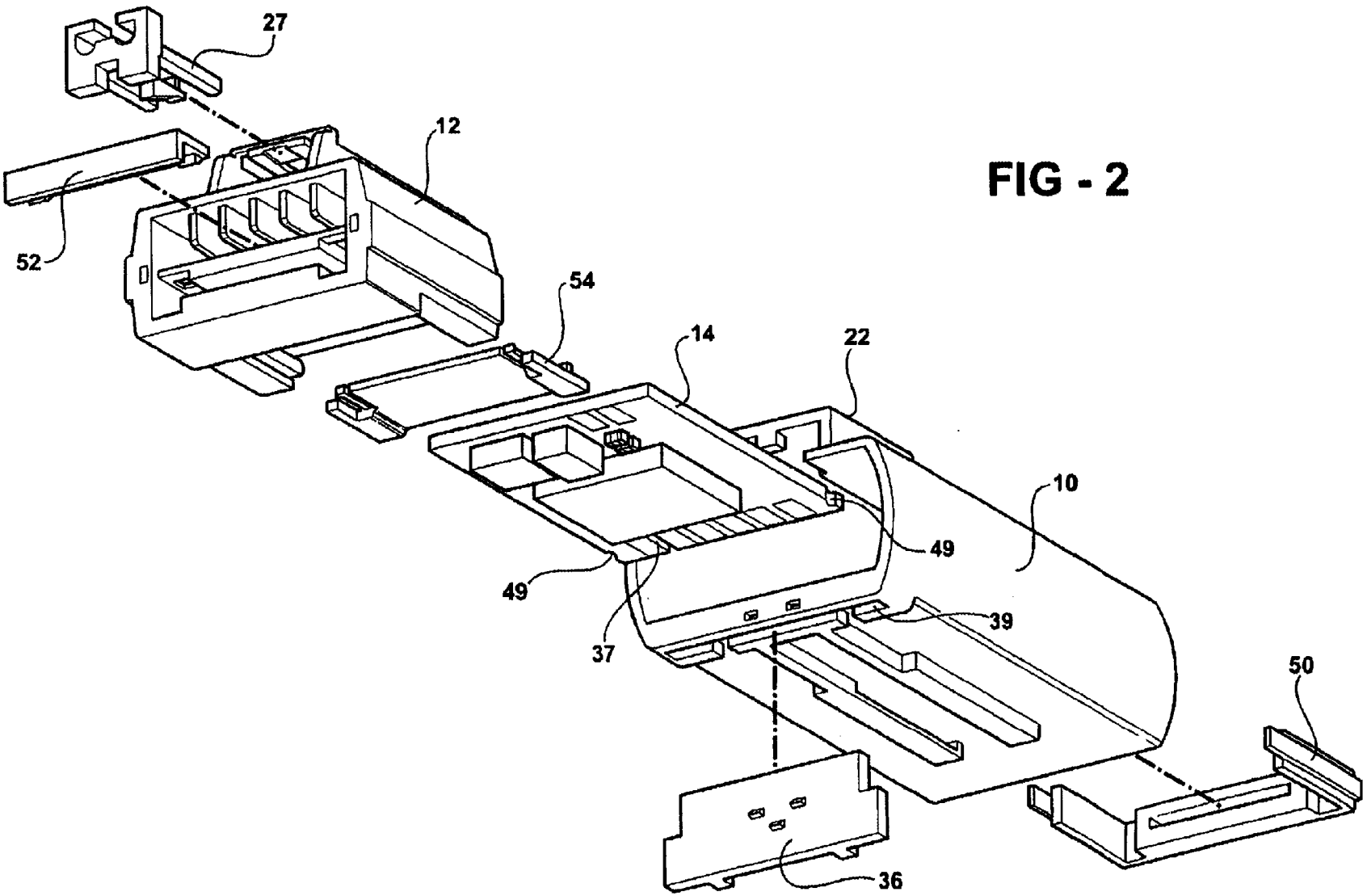
FIG. 2 is an exploded perspective view of the device of FIG. 1 from the bottom.
Figure 5:
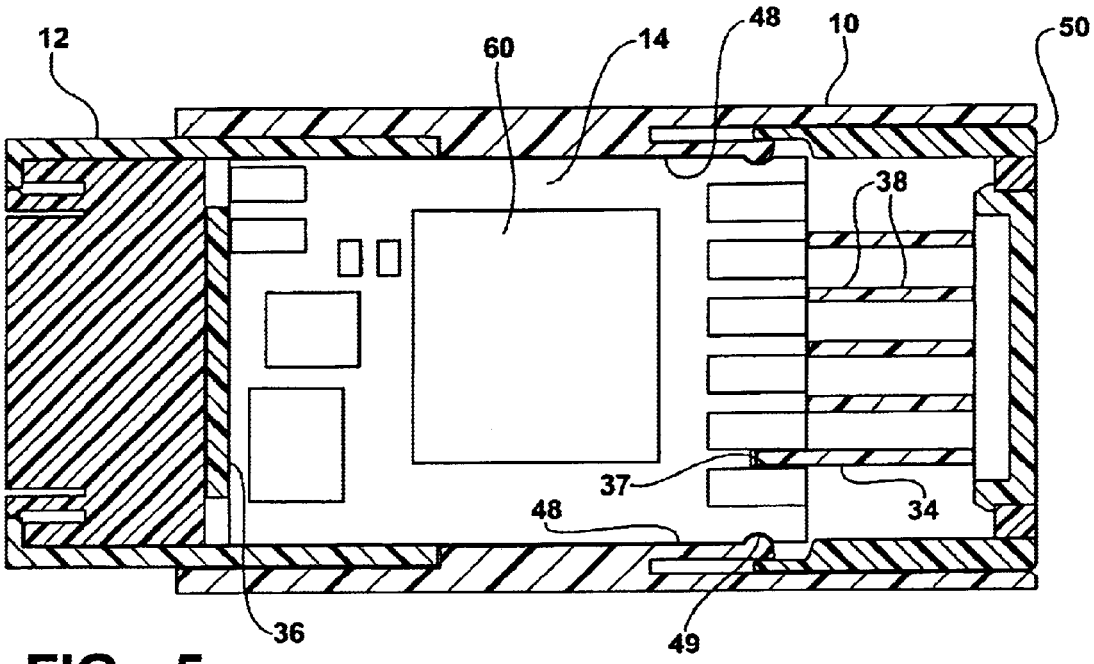
FIG. 5 is a sectional plan view showing the PCB layout and a second security means.

To ensure that the PCB 14 is properly oriented when inserted into the interior volume of the first connector 10, a slot 37, as best shown in FIGS. 2 and 5, is formed off-center in the leading edge of the PCB. A longitudinally extending rib 34 on the interior of the first connector fits snugly into the slot 37 only if the PCB 14 is inserted in the proper orientation; i.e., if it is inverted end for end, the rib 34 will hit the edge of the PCB 14 and not allow it to be fully inserted. Similarly, if the PCB 14 is rotated 180° about its longitudinal axis, the off-set nature of the rib 34 in the slot 37 will be such that again the PCB 14 can not be fully inserted. Only if in the proper orientation can the PCB 14 be fully inserted into the first connector 10.

Once the PCB 14 is fully and properly inserted in the correct orientation, a first position assurance latch 36 can be inserted into an opening 39 in the bottom of the first connector 10 as best shown in FIG. 2. The position assurance latch member 36 fits immediately behind the trailing edge of the PCB 14 as shown in FIG. 5 and can only be fully inserted into the body of the connector 10 if the PCB 14 is fully inserted. The latch member 36 also prevents the PCB 14 from being backed out during use.

As shown in FIG. 5, internal ribs 38 are integrally molded into the connector body 10 to define a series of parallel channels which receive the wires 18 and also receive the crimped spring terminals 40 and 42 to engage the edge contacts 16 on the upper and lower surfaces adjacent the leading edge of the PCB 14 when it is inserted into the connector 10 in the proper orientation. This eliminates the need for lead frames in providing electrical connectivity between the power source and ground and the intelligent components on the PCB 14.

Figure 3:
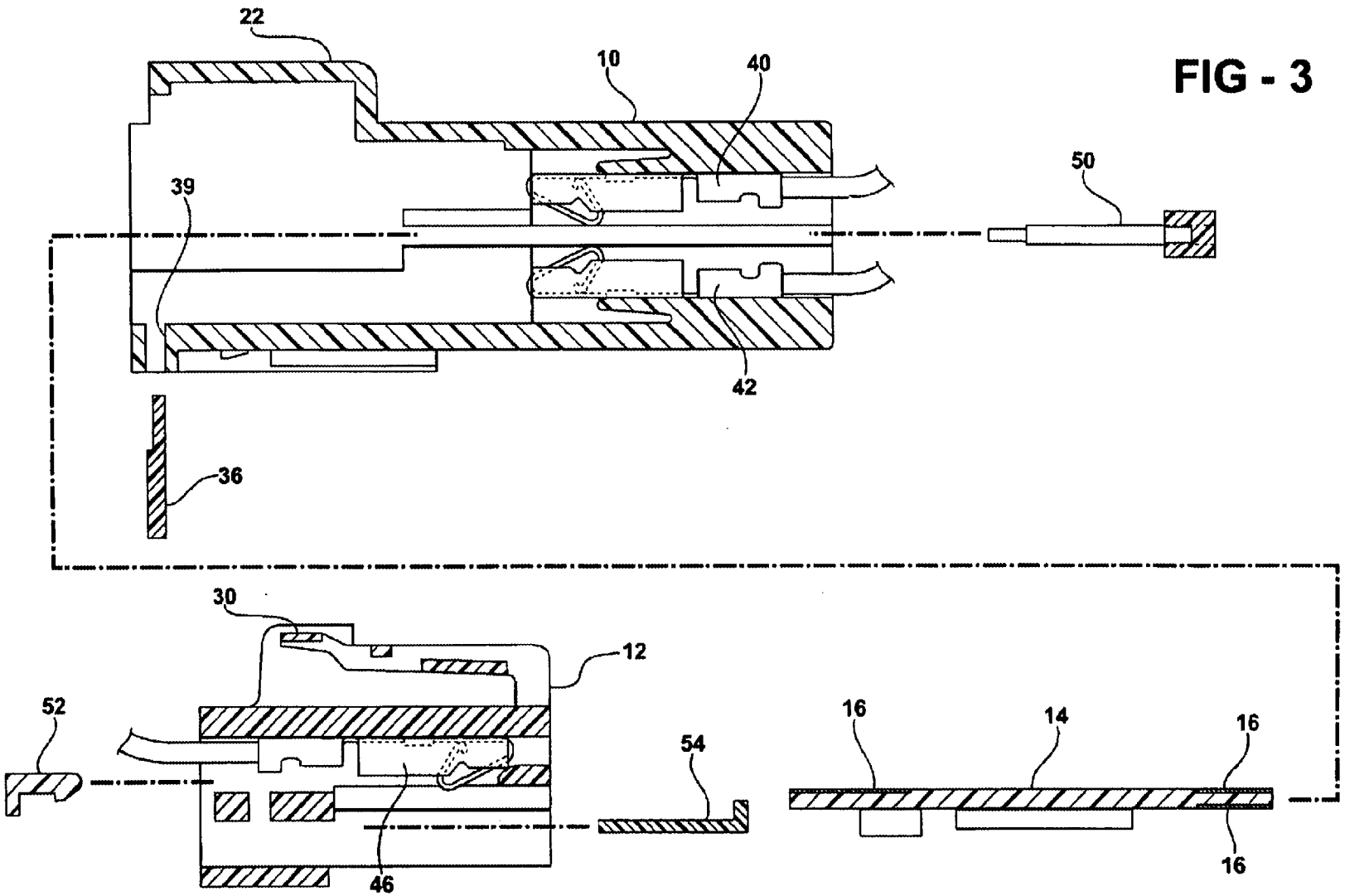
FIG. 3 is a sectional view of the device showing the crimped terminals and the security locking, detection and protection features.

Additional wire guide ribs 44 are integrally molded into the interior of the second connector 12 as best shown in FIG. 1. These ribs 44 also provide insertion channels or guides for the wires 20 as well as means to provide for the insertion of additional crimped wire end terminals 46. The terminals 46, like the terminals 40 and 42, have spring end portions to engage the edge contacts 16 on the lower surface adjacent the trailing edge of the PCB 14 as best shown in FIG. 3.

Additional position assurance for the proper insertion of the PCB is provided by interior bars 48 on the inside laterally opposite surfaces of the first connector 10 in registry with the PCB guide slot provided by ribs 32 and working in combination with detent notches 49 formed in the laterally opposite edges of the PCB 14 adjacent the lead edge thereof. The bars 48 and the small detent notches 49 receive and hold the PCB 14 in the fully inserted position. Thereafter, a C-shaped molded plastic security latch 50 is inserted into the open end of the first connector with arms which project into and behind the resilient detent arms 48 so as to prevent the detent arms from flexing outwardly. This essentially locks the PCB 14 in place. Alternatively, the interior bars 48 could be designed to be more difficult to separate from the detent notches 49, such that the bars themselves act as a more permanent lock without the help of security latch 50. The latch 50 could then be used simply as a PCB position assurance device.

Cover 52 is used to protect the contact surfaces of terminals 46. Additional latch 54 is provided to secure the crimped spring terminals of the second connector 12 in place as shown in FIG. 2. All of the latches are shaped and sized to slide into guideways providing some friction and may have detents to provide snap-fits as desired.

In use, the wires 18 and 20 are attached to the terminals 40, 42 and 46 by crimping and the terminals are assembled into their respective connector bodies 10 and 12. The PCB is loaded into the body 10 in the proper orientation. The latch 36 is driven into place to prevent the PCB from being removed from the connector 10. Cover 52 and latch 54 are assembled on the connector 12 after the terminals are installed. It will only be possible to fully insert the latch if the PCB is in the correct orientation and is all the way in. The connector 12 is then inserted into the connector 10. The components 60 on the PCB 14 are now ready to be energized by the power supply wires 20 and activate and control a device via output wires 18.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electrical connector comprising:

a first connector body having interior walls defining an interior volume and first and second axially opposite open ends;

means defining a plurality of wire channels in said first end extending into the interior volume;

conductive terminals disposed in at least some of said channels;

printed circuit board guide structures on the interior walls to receive and hold a printed circuit board within said volume;

a printed circuit board disposed within and held by said guide structures and having a lead edge with edge contacts in electrical contacting relationship with the conductive terminals disposed in said channels, the printed circuit board having laterally opposite edges adjacent the lead edge and a detent notch formed in at least one of said laterally opposite edges;

at least one bar in the guide structures on the interior walls of the first connector, the at least one bar interacting with the detent notch to hold the printed circuit board in position;

a second connector body having interior walls defining an interior volume and first and second axially opposite ends, said second connector body being of such size and shape as to fit telescopically into the second end of said first connector body;

means defining a plurality of parallel wire guide channels in the second end of said second connector body and conductive terminal means for connection to external wires in at least some of said channels, said conductive terminal means electrically contacting said circuit board; and latch means having first and second complementally interengaging portions on said first and second connector bodies to releasably latch said bodies together when telescopically engaged.

2. The apparatus as defined in claim 1 wherein said detent notch and bar provide a position assurance feature associated with said first connector body for accepting the printed circuit board into said guide structures in only one predetermined orientation.

3. The apparatus as defined in claim 1 further including a position assurance means insertable into said first connector body at right angles to an axis extending between said first and second axially opposite open ends of said first connector body to block movement of said printed circuit board from the inserted position.

4. The apparatus as defined in claim 1 further including a latching mechanism insertable into the first end of said first connector body, the latching mechanism having at least one arm for projecting behind the at least one bar to keep the bar from releasing from the detent notch.

5. The apparatus as defined in claim 1 wherein the first and second connector bodies are made of molded plastic.

6. The connector defined in claim 1 wherein the circuit board includes an intelligent circuit component which is connected with at least one of said conductive terminals when the board is inserted into said guide structures as the bodies are telescopically engaged.

7. A smart connector for intermediate location in an electrical circuit comprising:

first and second complemental connector bodies which can be latchingly joined together and latched to define an interior volume; the first connector body receiving output conductors and the second connector body receiving input conductors;

a printed circuit board disposed within said volume;

a rib formed in said first connector body and an off center slot defined in the circuit board whereby said rib is received in said slot only when said circuit board is inserted into said first connector body in a predetermined orientation and location;

said printed circuit board carrying at least one intelligent circuit component thereon and having conductive contacts formed at opposite ends thereof for electrical connection to said at least one intelligent circuit component; and first and second terminals mounted in said first and second bodies respectively with spring portions thereof in electrically conductive engagement with said contacts for connecting the input conductors and output conductors to the circuit board and said at least one intelligent circuit component mounted thereon when said connector bodies are latchingly joined together.

8. A connector as defined in claim 7 wherein guideways are provided in at least said second body to slidingly receive said circuit board.

* * * * *